US006834174B2

(12) United States Patent
Imaizumi et al.

(10) Patent No.: US 6,834,174 B2
(45) Date of Patent: Dec. 21, 2004

(54) IMAGE FORMING APPARATUS AND ROTARY BODY DETECTION DEVICE

(75) Inventors: Chikara Imaizumi, Shizuoka (JP); Kenji Watanabe, Shizuoka (JP); Seiji Obata, Shizuoka (JP); Takayuki Miyamoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 10/080,674

(22) Filed: Feb. 25, 2002

(65) Prior Publication Data

US 2003/0002887 A1 Jan. 2, 2003

(30) Foreign Application Priority Data

Feb. 26, 2001 (JP) ..... 2001-049787

(51) Int. Cl.[7] ..... G03G 15/00; G03G 15/01

(52) U.S. Cl. ..... 399/162; 399/167; 399/303

(58) Field of Search ..... 399/162, 167, 399/163, 36, 303, 312, 313

(56) References Cited

U.S. PATENT DOCUMENTS 4,031,466 A * 6/1977 Krause et al.
4,365,888 A * 12/1982 Hosaka et al. ..... 399/162
4,766,404 A 8/1988 Ishida et al.
5,006,890 A 4/1991 Ishida et al.
5,075,702 A 12/1991 Castelli et al.
5,243,396 A * 9/1993 Castelli et al. ..... 399/167
5,802,422 A * 9/1998 Hokari
5,933,687 A * 8/1999 Okuno et al. ..... 399/167
6,085,051 A * 7/2000 Miyasaka et al.
6,308,140 B1 * 10/2001 Dowling et al.
6,359,638 B1 * 3/2002 Saeki ..... 399/167
6,408,146 B1 * 6/2002 Nagano
6,409,576 B1 * 6/2002 Oguri et al.
6,501,930 B2 * 12/2002 Oku ..... 399/167

FOREIGN PATENT DOCUMENTS

JP 55164364 A * 12/1980 ..... G01P/3/486
JP 4-172376 6/1992
JP 4-234064 8/1992
JP 07303385 A * 11/1995 ..... G03G/15/01
JP 09267946 A * 10/1997 ..... G03G/15/00
JP 10206445 A * 8/1998 ..... G01P/3/486
JP 2000330353 A * 11/2000 ..... G03G/15/01

* cited by examiner

*Primary Examiner*—Susan Lee
(74) *Attorney, Agent, or Firm*—Fitzpatrick, Cella, Harper & Scinto

(57) ABSTRACT

An image forming apparatus includes an endless belt for carrying an image or for conveying an image forming medium, a driving roller connecting across the endless belt and driving the endless belt, a driven roller connecting across the endless belt and being driven in correspondence to movement of the endless belt, an image former for forming an image to the endless belt or to a medium conveyed by the endless belt, a speed detector for detecting moving speed of the endless belt and a speed controller for controlling the moving speed of the endless belt based on a detection result from the speed detector. The speed detector generates one pulse per rotation of the driven roller being driven in correspondence to the endless belt.

15 Claims, 7 Drawing Sheets

IMAGE FORMING APPARATUS AND ROTARY BODY DETECTION DEVICE

BACKGROUND OF THE INVENTION

1. Field of the Invention

This invention relates to an image forming apparatus, such as a copier, a printer, or a facsimile machine, having an endless belt for carrying an image or for conveying an image forming medium, and forming an image using an electrophotographic method. This invention also relates to a rotary body detection device.

2. Description of Related Art

Conventionally, among image forming apparatuses using an electrophotographic method or an electrostatic recording method in an image forming process, a type using a cylindrical photosensitive drum as an image carrier is commonly known, wherein the photosensitive drum is surrounded with surrounding devices (e.g, a charging unit, an exposing means, a developing unit, a cleaning unit) and a transfer material conveying mechanism (transfer material conveying means) or the like.

Presently, in means to improve the functions for the photosensitive drum and the transfer material conveying mechanism or the like, instead of using a photosensitive drum, an image forming apparatus using an endless belt for a photosensitive body serving as an image carrier, or an image forming apparatus using an endless belt for a transfer material conveying mechanism, has been developed.

Although numerous functions have been improved with the image forming apparatus using the endless belt for a photosensitive body or a transfer material conveying mechanism, such image forming apparatus requires a speed control means for controlling change in moving speed of the endless belt caused by internal warming of the image forming apparatus body or change in the environmental temperature, which are distinctive problems for such belt mechanism.

Typically, the tolerance for an outer diameter of a driving roller for driving the endless belt is strictly defined so that the moving speed of the endless belt precisely conforms with a recording position. However, due to the internal warming of the image forming apparatus body or change in the environmental temperature, the driving roller expands or contracts to change the moving speed of the endless belt, and results in problems such as deterioration in the precision of recording position and degrading of image quality.

Therefore, conventionally, methods such as using a material resistant to heat expansion for the driving roller, or measuring the temperature surrounding the driving roller and anticipating the diameter of the roller, have been used as a speed controlling means for controlling the moving speed of the endless belt.

However, the aforementioned methods are unable to satisfactorily prevent deviation in color or unevenness in density caused by a slight deviance in position.

In means to control the change in speed caused by eccentricity of the driving roller, Japanese Patent Publication (Kokai) No. Hei 4-172376, Hei 4-234064, or Hei 4-234064 show an example where a rotary encoder is disposed on an axis of a driven roller being rotatively driven by an endless belt to detect the rotation angle speed and to control the rotary speed of the motor of the driving roller on the basis of the detected result.

The method of detecting the moving speed of the endless belt from the driven roller is effective not only for controlling the change in speed from the eccentricity of the driving roller, but is also effective for controlling the change in speed from thermal expansion.

Nevertheless, using a precise rotary encoder leads to a problem of considerable cost increase.

Accordingly, this invention has as an object to detect change in moving speed of the endless belt from thermal expansion more simply and precisely.

SUMMARY OF THE INVENTION

For accomplishing the foregoing object, a representative structure of this invention is an image forming apparatus comprising: an endless belt for carrying an image or for conveying an image forming medium; a driving roller connecting across the endless belt for driving the endless belt; a driven roller connecting across the endless belt for being driven in correspondence to movement of the endless belt; an image forming means for forming an image to the endless belt or to a medium conveyed by the endless belt; a speed detection means for detecting moving speed of the endless belt; and a speed control means for controlling the moving speed of the endless belt based on a detection result from the speed detection means; wherein the speed detection means generates one pulse per rotation of the driven roller being driven in correspondence to the endless belt.

Thus structured, a mechanical precision of a pulse signal generating portion (e.g, the eccentricity of the rollers) can be ignored to allow a simpler and more precise detection in the movement speed of the endless belt.

The speed detection means can easily emit a signal by generating a signal from a notch or a perforation formed at a portion of the driven roller.

Position of the speed detection means and an axis of the driven roller can be secured and a signal can constantly be generated stably so that the rotation of the driven roller can be steadily detected by forming the notch or the perforation on an axis end portion of the driven roller, fixing the speed detection means to an axial bearing of the driven roller or to an axial bearing securing member for securing the axial bearing, and generating a signal by passage and blockage of light from the notch or the perforation formed on the axis end portion of the driven roller.

The speed control means being based on a pulse count of the driven roller when the value of movement of the endless belt, the driven roller, and the driving roller is substantially equal to a common multiple of a peripheral length of the driven roller and a peripheral length of the driving roller can prevent error from change of speed caused by the eccentricity of the driven roller and enhance precision in controlling the endless belt.

The speed detection means being based on a pulse count of the driven roller when the value of movement of the endless belt, the driven roller, and the driving roller is substantially equal to a common multiple of a peripheral length of the driven roller and a peripheral length of the endless belt can prevent error from change of speed caused by uneven thickness or the like of the endless belt, and enhance precision in controlling the endless belt.

Further, the driven roller having a coefficient of linear expansion substantially equal to a coefficient of linear expansion for a member which defines the interval of the image forming means can prevent deviation in color when actually forming an image since a movement value of the driven roller when the belt speed is detected as moving slower than the actual speed thereof can be substantially balanced with a value of the thermal expansion from the position of the image forming means, and when a plurality of image forming means are disposed with a predetermined interval on the endless belt.

In a rotary body detection device serving to detect the speed of a rotary body and comprising a rotary body and a sensor for generating a signal by passage and blockage of light, a rotation speed of the rotary body can be easily detected by forming a notch or a perforation at a portion of the rotary body, and by allowing the sensor to generate a signal by passage and blockage of light from the notch or the perforation.

The sensor can be precisely positioned to allow precise generation of a signal by defining a relative position between an axial bearing of the rotary body or the axial bearing securing member for securing the axial bearing.

BRIEF DESCRIPTION OF THE DRAWINGS

The above and other objects and features of the invention are apparent to those skilled in the art from the following preferred embodiments thereof when considered in conjunction with the accompanying drawings, in which.

DESCRIPTION OF THE PREFERRED EMBODIMENTS

Preferred embodiments of this invention are described in more detail below with reference to the drawings. However, it is to be noted that measurements, material, shape, and arrangement or the like regarding the comprising members described in the following embodiment can be changed according to the structure and various conditions for this invention, and also that the following description is not to be limitative of the scope of this invention unless restricted in particular.

First embodiment

Figure 1:
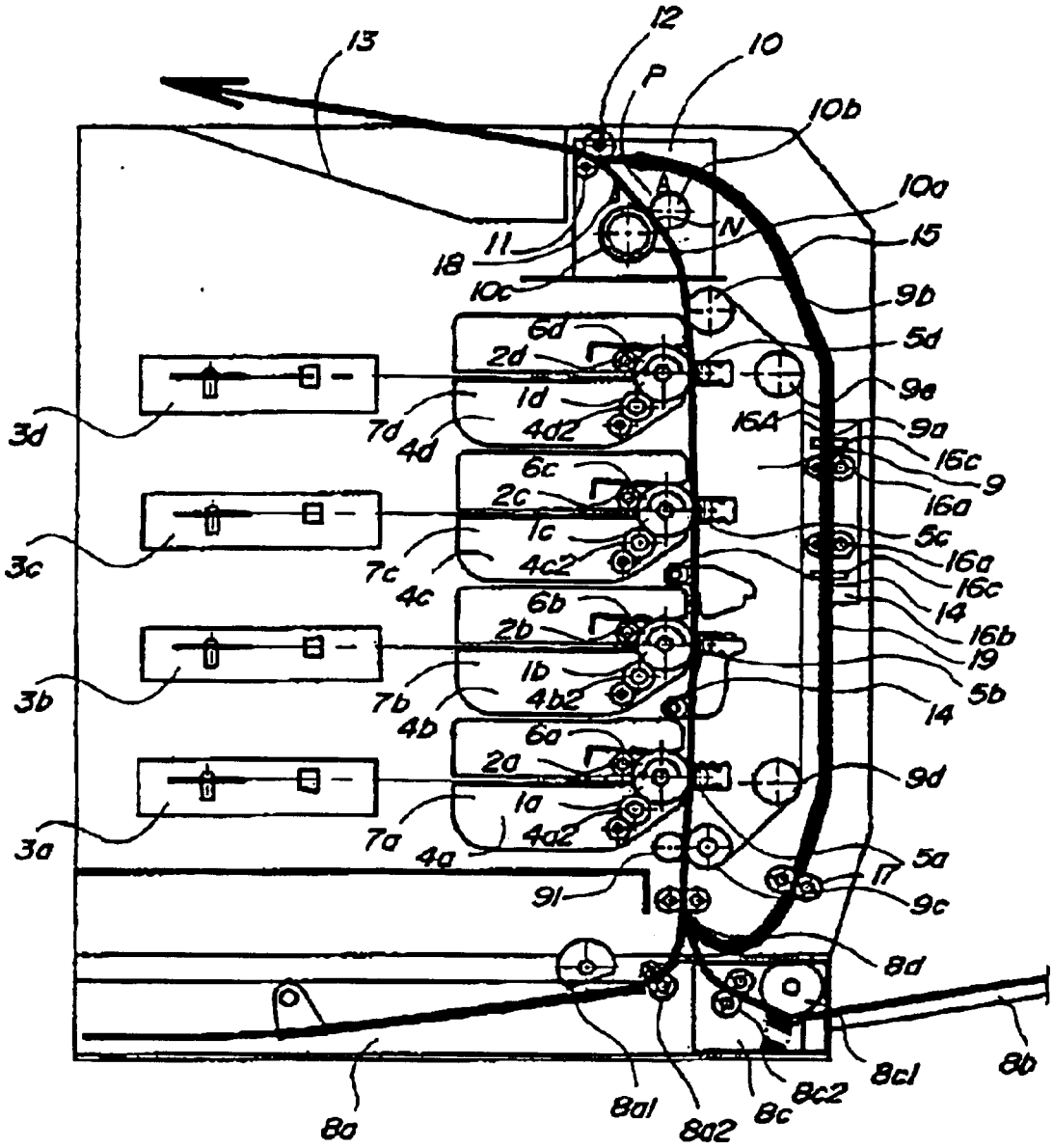
FIG. 1 is a schematic cross-sectional view showing a color image forming apparatus for belt speed control of a belt conveying apparatus according to this invention.

FIG. 1 is a cross-sectional view showing a schematic of a color image forming apparatus according to the first embodiment of this invention.

The color image forming apparatus shown in FIG. 1 has four photosensitive drums 1 (1*a*, 1*b*, 1*c*, 1*d*); each photosensitive drum 1 is, for example, surrounded by a charging means 2 (2*a*, 2*b*, 2*c*, 2*d*) for charging equally to the surface of the photo sensitive drum 1, an exposing means 3 (3*a*, 3*b*, 3*c*, 3*d*) for forming an electrostatic latent image upon the photosensitive drum 1 by irradiation of a laser beam based on image information, a developing means 4 (4*a*, 4*b*, 4*c*, 4*d*) for visualizing a toner image by sticking toner to the electrostatic latent image, a transferring means 5 (5*a*, 5*b*, 5*c*, 5*d*) for transferring the toner image on the photosensitive drum 1 to a transfer material, and a cleaning means 6 (6*a*, 6*b*, 6*c*, 6*d*) for removing the transferred toner remaining on the surface of the photosensitive drum 1; and such arrangement forms an image forming means.

The photosensitive drum 1 serving as an image carrier, the charging means 2 serving as a processing means operating upon the photosensitive drum 1, the developing means 4, and the cleaning means 6 for removing the toner are formed into a united body of a cartridge type to form a process cartridge 7 (7*a*, 7*b*, 7*c*, 7*d*).

A conveying means 9 comprising of an electrostatic conveying belt A conveys a transfer material S fed from a feeding portion 8 to the image forming means, and after a color image is recorded by orderly transferring a toner image of each color to the transfer material S, the transfer material S has an image fixed thereto at a fixing portion 10, and is discharged from at a discharge portion 13 by a pair of discharge rollers 11, 12.

In double-side recording, before the transfer material S has an image fixed thereto at the fixing portion 10 and is discharged by the pair of discharge rollers 11, 12, the transfer material S is conveyed (in a direction indicated by arrow A) to a double-side conveying path 15 by reversing the pair of discharge rollers 11, 12. The transfer material S conveyed by the double-side conveying path 15 passes an inclined conveying roller 16 arranged in the front of the apparatus body, is conveyed to a U-turn roller 17 in a perpendicular downward direction, and is conveyed to the image forming portion by the U-turn roller 17 and a resist roller 8*d*.

Next, each comprising portion is described in order as follows.

(Feeding Portion)

The feeding portion 8 comprises a sheet-feeding cassette 8*a*, a multi-sheet-feeding tray 8*b* serving as a multi-feeding apparatus, a multi-feeding portion 8*c*, and a resist roller 8*d*.

The sheet-feeding cassette 8*a* is stored with plural transfer materials S, and is loaded inside a bottom portion of the apparatus body. In image forming from the sheet-feeding cassette 8*a*, the transfer material S is separated and conveyed one sheet at a time by a cassette pickup roller 8*a*1, and is conveyed to the image forming portion by a cassette conveying roller 8*a*2 and the resist roller 8*d*.

Next, although the multi-sheet-feeding tray 8*b* is usually stored at the front of the apparatus body, the multi-sheet-feeding tray 8*b* when in use, is turned and opened from the apparatus body, and has plural transfer materials S arranged thereupon. In image forming from the multi-sheet-feeding tray 8*b*, the transfer material S is separated and conveyed one sheet at a time by a multi-pickup roller 8*c*1, and is conveyed to the image forming portion by a multi-conveying roller 8*a*2 and the resist roller 8*d*.

In such conveying operation, a sheet-feeding path from the multi-feeding apparatus, which is used for a transfer material such as a thick paper, an envelope or a special paper being relatively resistant to electrostatic absorption against a surface of a belt 9*a* or being considerably elastic, has a curve to curl the transfer material when the transfer material reaches the belt 9*a* so that a front and rear portion thereof contacts to the surface of the belt 9*a* while a center portion thereof is floated.

Although a sheet-feeding path from the cassette shown in FIG. 1 has a curve for curling the transfer material so that a front and rear portion thereof is floated and curled backward, such structure of the cassette-sheet-feeding path shown in FIG. 1 would not be a problem since the transfer material used for the cassette-sheet-feeding path has a relatively low elasticity and easily allows electrostatic absorption against the surface of the belt 9*a*.

The separation and conveyance of the transfer material regarding the sheet-feeding cassette 8*a* and the multi-feeding portion 8*c* are performed by a row of driving gears of a sheet-feeding motor (not shown).

(Image Forming Structure)

The photosensitive drum 1 serving as an image carrier is an aluminum cylinder having an outer surface of an organic photoconducting layer (OPC). The photosensitive drum 1 is rotatively supported by a flange arranged on each end portion, and is rotatively driven counter clockwise in an arrow direction by transmitting a driving force to one of the end portions from a driving motor (not shown).

Each of the charging means 2 uniformly charges the surface of the photosensitive drum 1 by contacting a conductive roller formed into a roller shape against a surface of the photosensitive drum 1 while applying thereto a charging bias voltage from an electric source (not shown).

The exposing means 3 has a polygon mirror, and an image beam corresponding to an image signal is emitted to the polygon mirror from a laser diode (not shown).

The developing means 4 comprises, for example: toner portions 4*a*1, 4*b*1, 4*c*1, 4*d*1 where each contain a toner for the colors of black, cyan, magenta and yellow; and developing rollers 4*a*2, 4*b*2, 4*c*2, 4*d*2 for performing developing by being arranged adjacent to the surface of the photosensitive drum, being rotatively driven by a driving portion (not shown), and being applied with developing bias voltage from a developing bias electric source (not shown).

At an inner side of an electrostatic conveying belt 9*a* (described afterwards), a fixing means 5*a*, 5*b*, 5*c*, 5*d* arranged opposite from four of the photosensitive drums 1*a*, 1*b*, 1*c*, 1*d* contacts with the electrostatic conveying belt 9*a*, respectively. The fixing means 5 are connected to a transfer bias electric source (not shown) for applying a positive charge to the transfer material via the transfer conveying belt 9*a*, and resulting from this electric field, a negative toner image on the photosensitive drum 1 for each color is transferred to the transfer material contacting to the photosensitive drum 1 to form a color image.

(Transfer Material Conveying Structure)

The conveying means 9 conveys the transfer material S from the feeding portion 8 to an image forming area.

The electrostatic conveying belt 9*a* serving as an endless belt (transfer material carrier) comprising the conveying means 9 is stretchingly supported by four rollers which are a driving roller 9*b*, a tension roller 9*d*, and driven rollers 9*c*, 9*e*, and is arranged opposite from all four of the photosensitive drums 1*a*, 1*b*, 1*c*, 1*d*. Since the electrostatic conveying belt 9*a* is required to be steadily driven by the driving roller 9*b* without slipping, a metal roller wrapped with a thin rubber or the like having a thickness of approximately 1 mm is used as the driving roller 9*b* in consideration of a driving grip performance and durability of the electrostatic conveyor belt 9*a*.

However, since the coefficient of linear expansion for an elastic material, such as rubber or the like, is larger in comparison with a metal material, such elastic material causes expansion or contraction due to internal warming or a change in environmental temperature and results in change in diameter of the driving roller 9*b*. Therefore, even if the electrostatic conveying belt 9*a* is driven with the same rotary count by the driving roller 9*b*, the belt driving speed (moving speed of the conveying belt 9*a*) will change and cause phenomena such as deterioration in precision of recording position and decrease in image quality.

Figure 5:
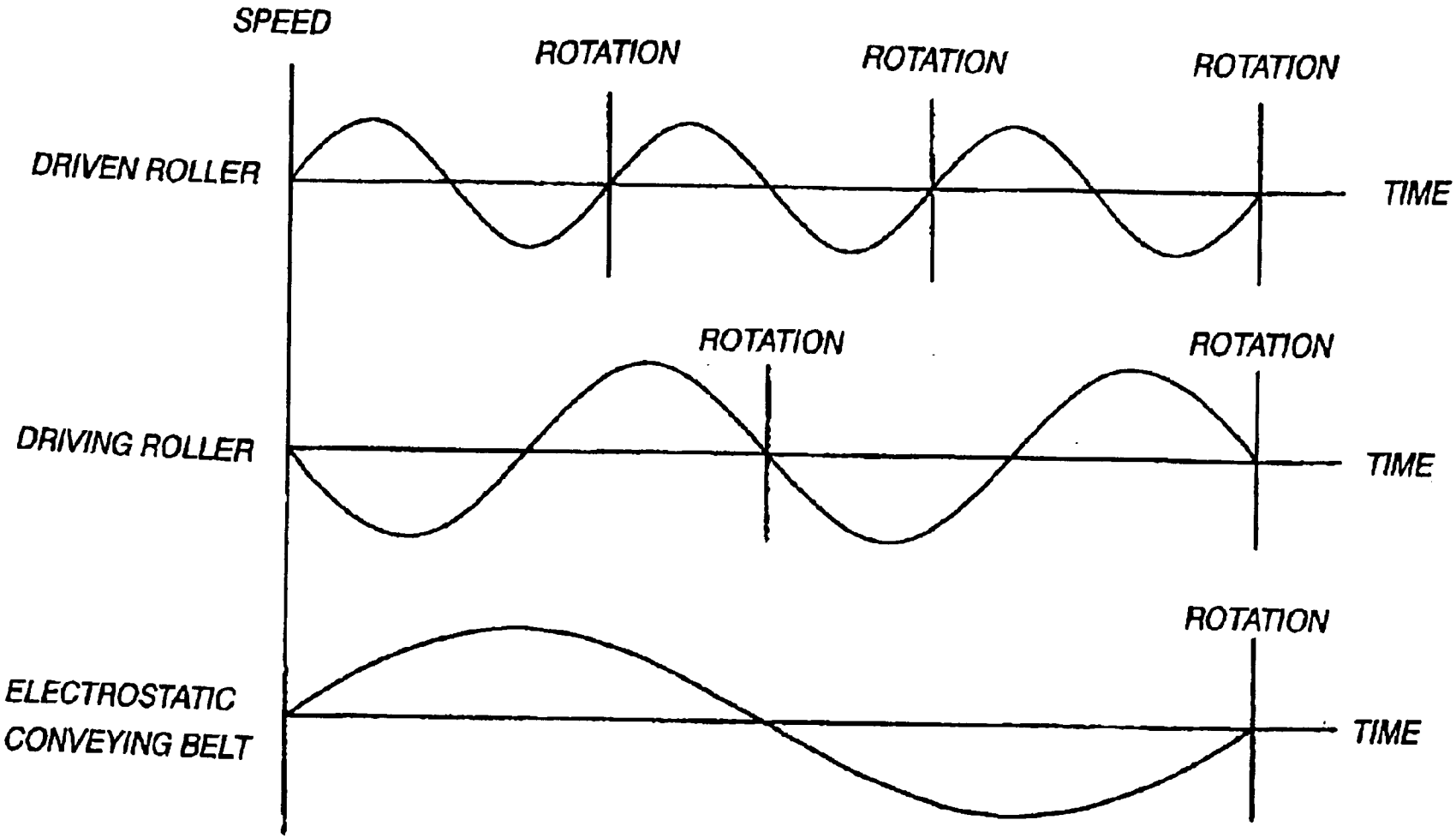
FIG. 5 is a view showing the change of speed for a driving roller, a driven roller, and an endless belt of the image forming apparatus of this invention.

Accordingly, a means to detect and control the speed (moving speed) of the electrostatic conveying belt 9*a* is required. As a means for detecting such speed, the apparatus of this embodiment has a notch 26 and a sensor 20 formed at an end portion of an axis 25 of the driven roller 9*c*. As shown in FIG. 5, the sensor 20 serving as a speed detecting means detects the speed of the electrostatic conveying belt 9*a* from a pulse signal generated each time the driven roller 9*c* (or driven roller 9*e*) rotating in correspondence to the electrostatic conveying belt 9*a* makes one rotation, and based on the detected result, a speed controlling means 21 feeds back to a driving motor 22 serving as the driving source for the driving roller 9*b* and controls the rotation count of the driving motor 22 so that the moving speed of the electrostatic conveying belt 9*a* can be controlled.

Although a roller for detection has an eccentricity or the like to cause unevenness in rotation speed, the method of detecting one pulse per rotation of the driven roller has an advantage of not causing error from the detecting side, since the time for one rotation is always the same.

Figure 2:
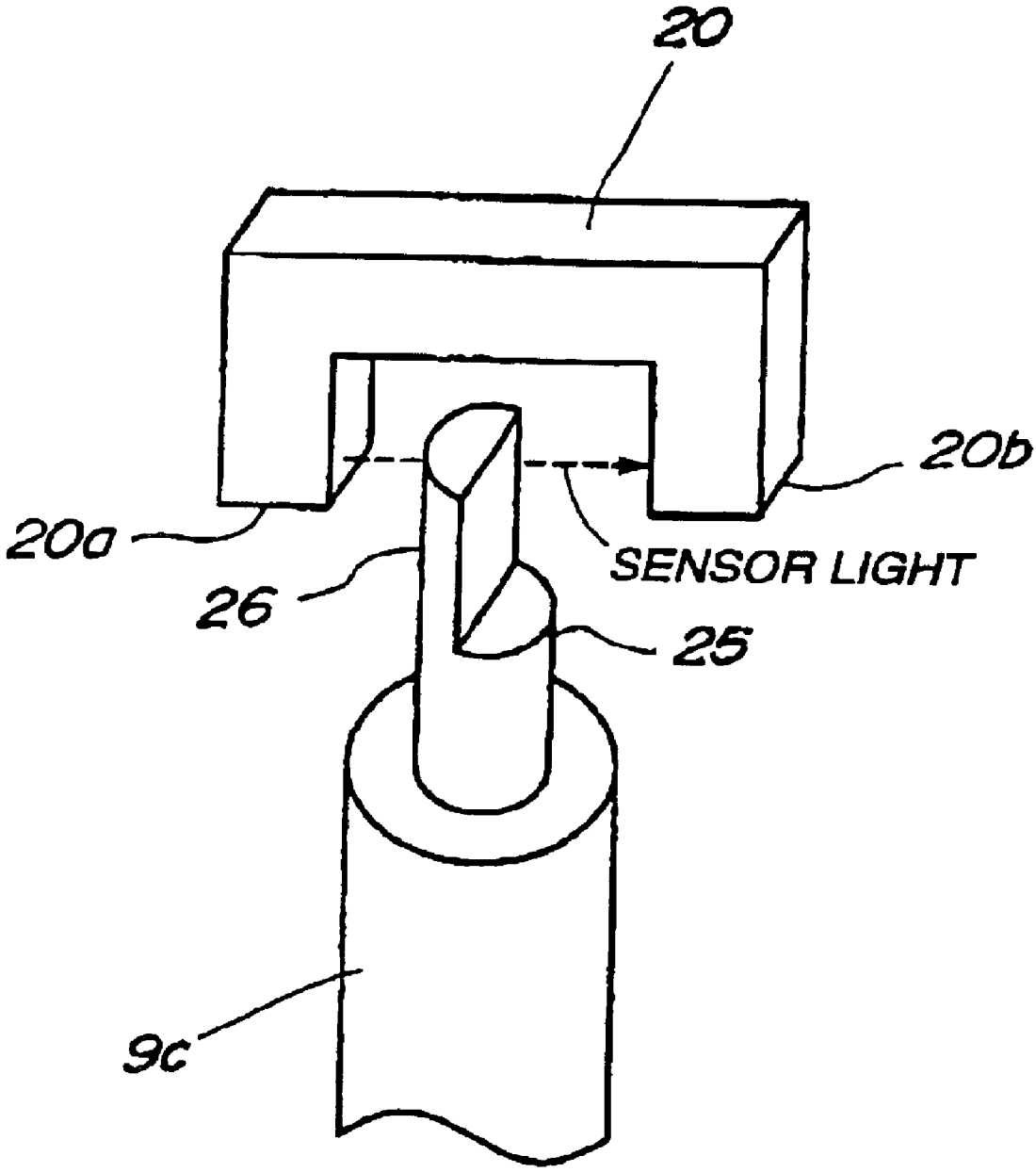
FIG. 2 is a schematic cross-sectional view showing a signal generating portion of a driven roller portion according to this invention which generates one pulse per rotation.
Figure 3:
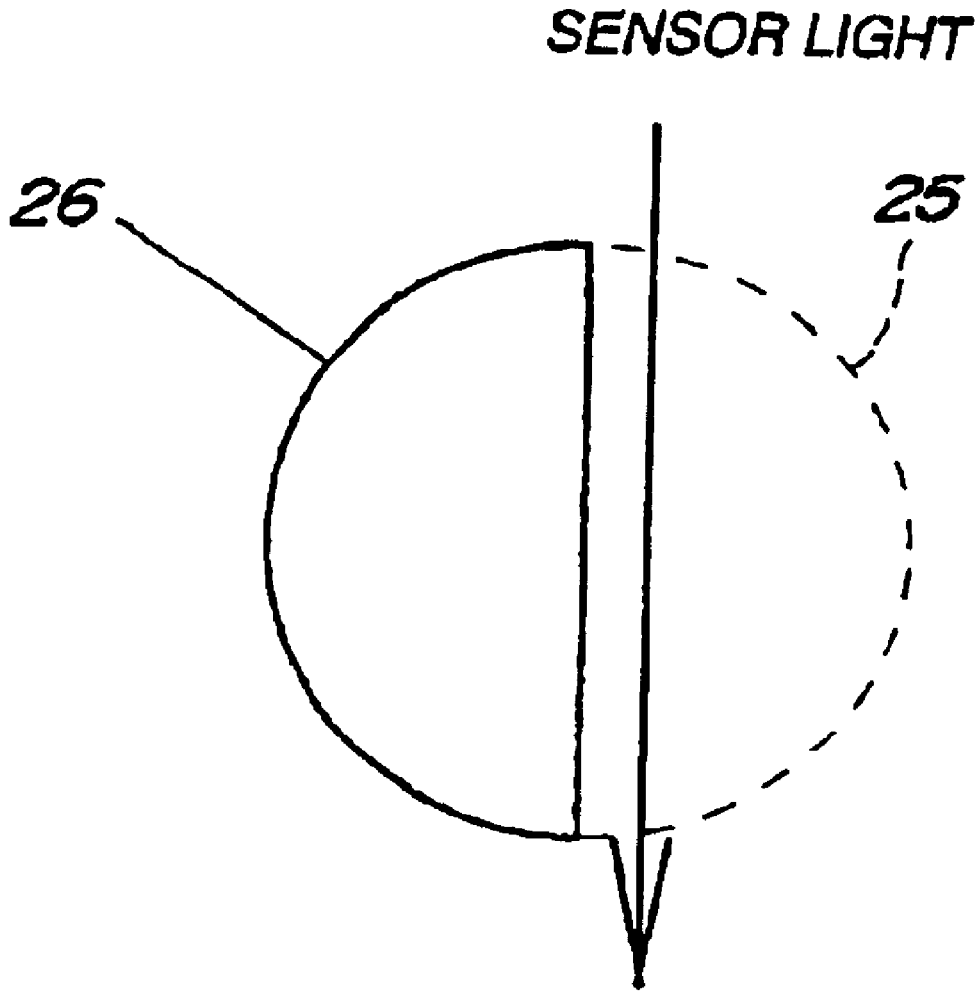
FIG. 3 is a more simplified view of FIG. 2.
Figure 4A:
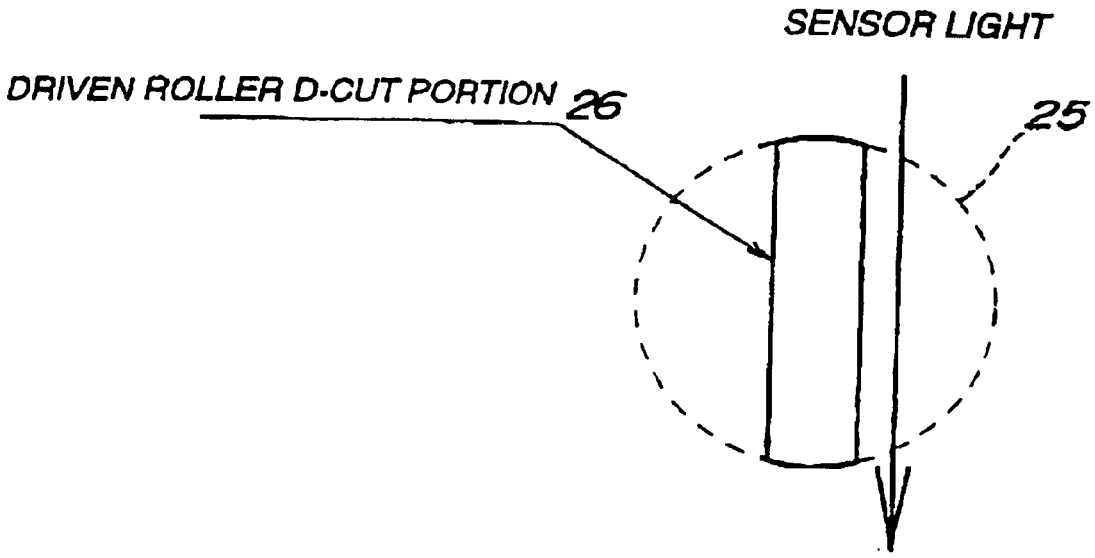
FIG. 4 is a view showing a structure of a driven roller portion according to this invention which generates two pulses per rotation (FIG. 4(*a*) shows two-sided D-cut, FIG. 4(*b*) shows one-sided D-cut with two pulses generated)
Figure 4B:
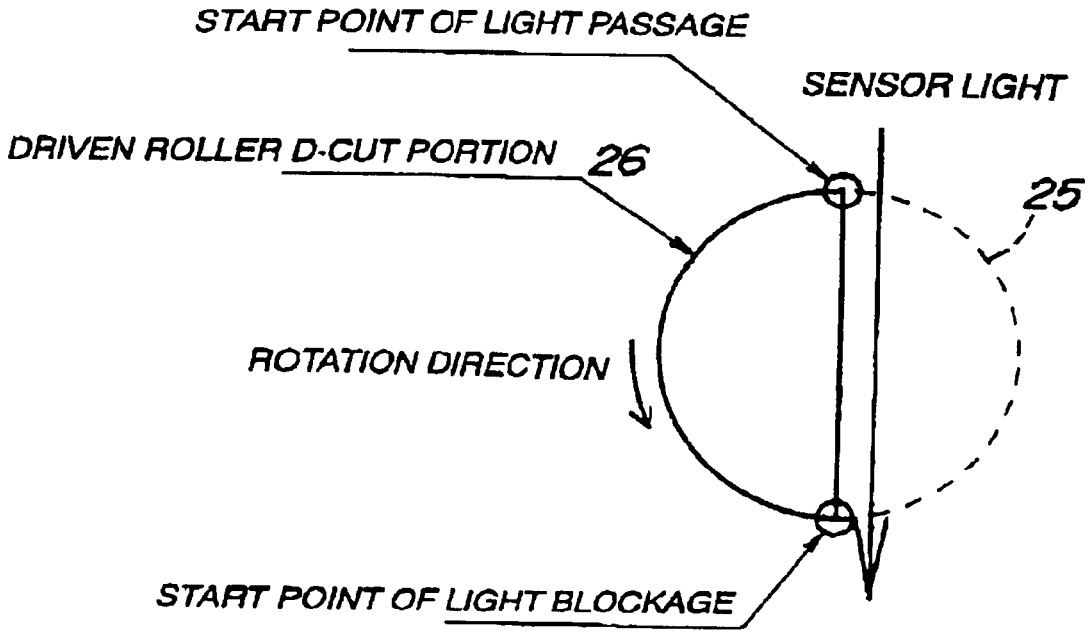

An example of a method for creating one pulse per rotation of the driven roller is a method of notching or perforating a portion of the driven roller. As shown in FIG. 2 and FIG. 3, the edge portion of the axis 25 of the driven roller 9*c* (or the driven roller 9*e*) has a prescribed arc and chord cut out therefrom to form a D-cut portion (such as a D-cut portion 26 shown in the drawing) or a groove or the like. Nevertheless, when just a D-cut portion is formed, the time approximately equivalent to that for making one rotation is necessary in order to begin reception of a signal when a signal is generated just after the reception of a signal has begun. Therefore, when time is required to be reduced, plural pulses rather than a single pulse can be generated as a signal corresponding to one rotation of the driven roller (e.g., with a method of forming a D-cut portion on each axis-end (see FIG. 4(*a*) or with a method of using two pulses corresponding to the time when light is blocked off and when light is passed through (see FIG. 4(*b*)) so that a signal soonest from the beginning of the reception of signals can be received as the pulse for a single rotation and shorten the time in waiting for the reception of signals to begin.

As shown in FIG. 2, the sensor 20 serving as a speed detecting means has a light emitting portion 20*a* on one end and a light receiving portion 20*b* on the other end, has a side shaped as a closed bracket letter, and is arranged to dispose an axis-end portion 25 of the driven roller 9*c* (or driven roller 9*e*) between the light emitting portion 20*a* and the light receiving portion 20*b*. The D-cut portion 26 formed on the axis-end portion 25 intermittently blocks sensor light from the light emitting portion 20*a* to the light receiving portion 20*b* so as to detect the rotation of the driven roller 9*c* and send one pulse signal corresponding to one rotation to a control unit.

Further, the speed controlling means of the electrostatic conveying belt 9*a* calculates the time T required for a pulse count K in reaching a prescribed number corresponding to a prescribed moving distance L of the electrostatic conveying belt 9*a* and controls the driving motor to stabilize the time. The same result can be obtained by making a calculation of S (speed) =L/T and controlling the driving motor 22 so as to derive a uniform output. That is, the driving motor 22 is controlled for stabilizing the time required for the driven roller 9*c* to rotate to a prescribed number of times K.

Nevertheless, since the driving roller 9*b* and the driven roller 9*e* are both eccentric, the prescribed distance L is set to have a distance substantially equal to the moving distance of the electrostatic conveying belt 9*a* when driving roller 9*b* and driven roller 9*c* rotate for an integral number of time(s) so that detection error caused by unevenness of speed from the eccentricity of the driven roller 9*c* can be prevented to increase speed control precision. That is, the prescribed distance L is set to be substantially equal to a common multiple of the circumferential length of the driven roller and the circumferential length of the driving roller. Describing the foregoing more precisely, the prescribed distance L is set to be substantially equal to a common multiple of the moving distance Lc of the electrostatic conveying belt 9*a* for one rotation of the driven roller 9*c* and the moving distance Lb of the electrostatic conveying belt 9*a* for one rotation of the driving roller 9*b* since the circumferential length of a roller and the moving distance for one rotation do not always match when considering the thickness of a electrostatic conveying belt.

$$L \approx n1 \times Lc$$

$$L \approx n2 \times Lb$$

(n1 is the first integer, n2 is the second integer)

Further, detection error caused by the unevenness of speed from the unevenness in the thickness of the electrostatic conveying belt 9*a* can be prevented by setting the prescribed distance L to be substantially equal to a common multiple of the circumferential length of the driven roller and the circumferential length of the electrostatic conveying belt 9*a*. More precisely, the prescribed distance L is set to be substantially equal to a common multiple of the moving distance for one rotation of the driven roller 9*c* and the moving distance La of the electrostatic conveying belt 9*a* for one rotation of the electrostatic conveying belt 9*a*.

$$L \approx n3 \times La$$

(n3 is the third integer)

In FIG. 5, the prescribed distance L is set to have a distance substantially equal to: the moving distance for one rotation of the electrostatic conveying belt 9*a* (1 time); the moving distance for two rotations of the driving roller 9*b* (two times); and the moving distance for three rotations of the driven roller 9*c* (three times).

The sizes for the electrostatic conveying belt 9*a*, the driving roller 9*b*, and the driving roller 9*b* should be set so that the moving distance for one rotation of the electrostatic conveying belt 9*a* is substantially equal to the integral multiple for the moving distance for one rotation of the driving roller 9*b* and the moving distance for one rotation of the driven roller 9*e*, but should not be limited to the above-mentioned-sizes.

In this embodiment, it is to be noted that when the driven roller rotates three times, the driving roller rotates exactly twice, and the electrostatic conveying belt rotates once.

Although the driven roller has a considerably low thermal expansion rate, in which the actual thermal expansion in the diameter for the driving roller is approximately 0.34% under the warming temperature of 30° C., and the thermal expansion in the diameter for the driven roller for speed control is approximately 0.035% under the warming temperature of 30° C., thermal expansion is not ignorable for further prevention of detection error since thermal expansion is a direct cause of measurement error.

Figure 6:
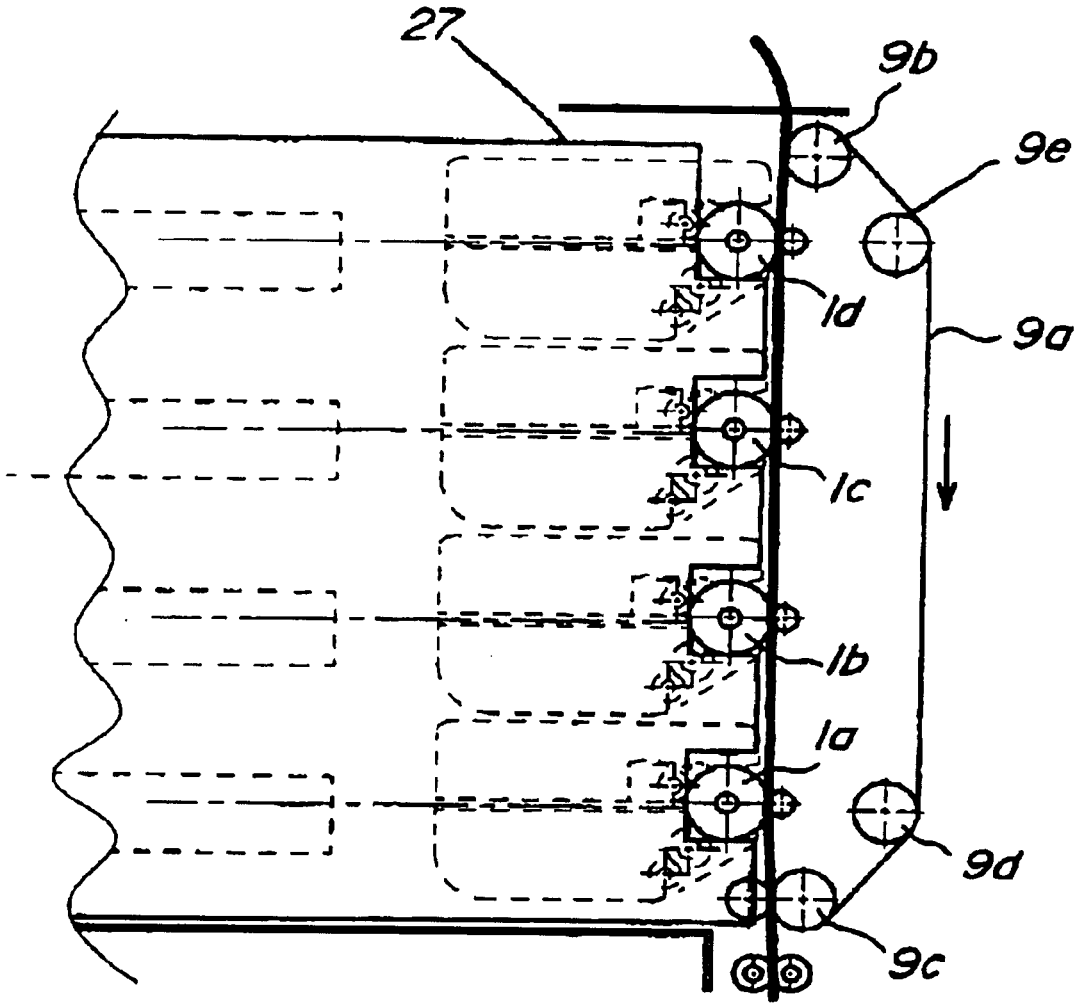
FIG. 6 is a schematic view showing a member for defining an interval for a photosensitive drum of each image forming means.

Accordingly, as shown in FIG. 6, the coefficient of linear expansion of the driven roller is set to be substantially equal to the coefficient of linear expansion of a member (see side-panel 27 of FIG.6) which defines an interval for the photosensitive drums 1 serving as the image forming means arranged with a prescribed interval on the electrostatic conveying belt 9*a*; accordingly, even when the driven roller has thermally expanded to cause extension in the time for one rotation, an increased distance caused by the belt speed being erroneously detected as moving slower than the actual speed thereof to cause the electrostatic conveying belt 9*a* to move faster than intended and an expanded distance caused by the expansion in the distance between each image forming apparatus will be substantially balanced so that color deviation for each color can be prevented during an actual forming of an image.

Figure 7:
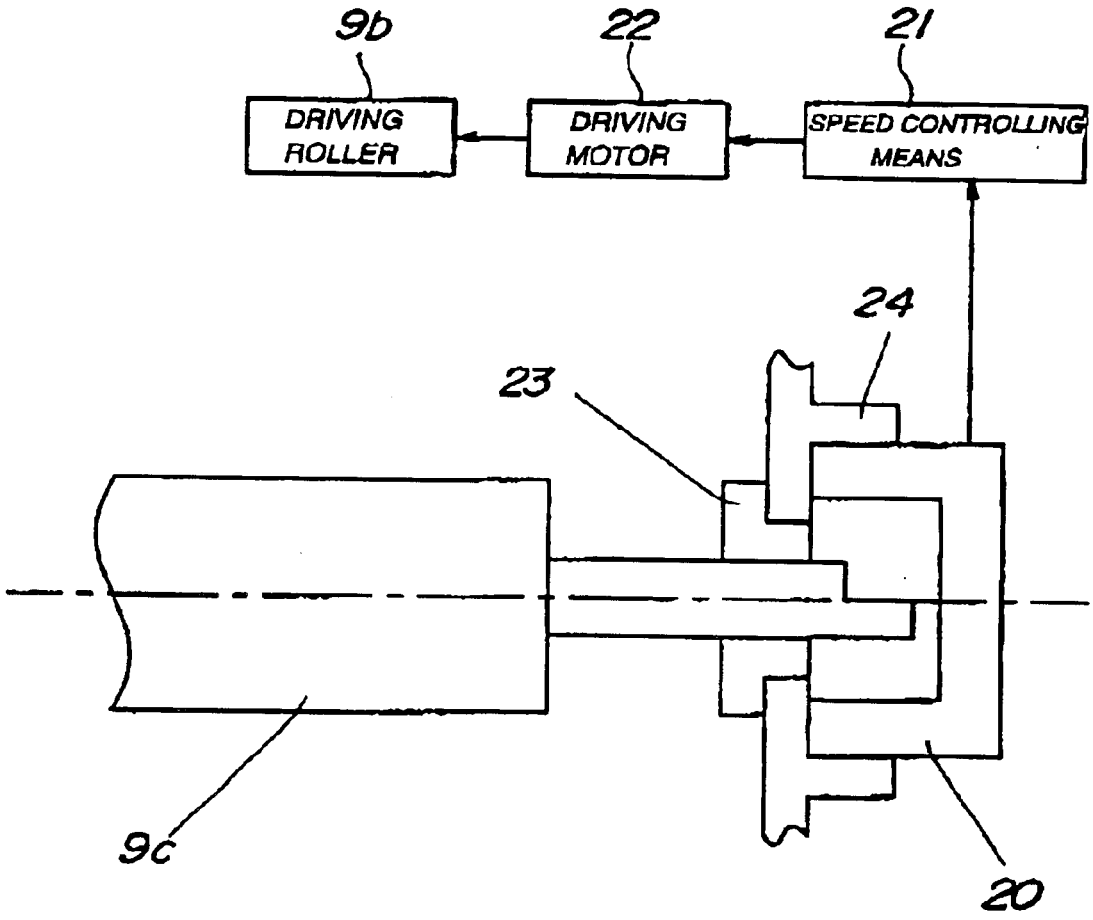
FIG. 7 is an explanatory view showing a surrounding of a speed detecting sensor attachment portion according to this invention.

Position of the roller and the sensor are important for steadily detecting the speed of the driven roller serving as a rotary body. Position is vital for performing constant and steady generation of a signal, and FIG. 7 shows an example of a method for arranging such position in which the sensor 20 is directly positioned to an axial bearing securing member 24 for securing an axial bearing 23 of the driven roller 9*c* (or the driven roller 9*e*). Thus structured, a position between the driven roller 9*c* having the D-cut axis-end portion formed thereto and the sensor 20 can be defined precisely so that the speed of the driven roller 9*c* can constantly and steadily be detected, and also allow the electrostatic conveying belt 9*a* to be rotatively driven at a steady speed based on a detected result.

Thus structured, the electrostatic conveying belt 9*a* is driven steadily by the driving roller 9*b* to enable circulatory movement, in which the transfer material S is electrostatically absorbed to an outer surface facing the photosensitive drums 1 and contacted against the photosensitive drums 1.

Arranged at an upstream most position of the electrostatic conveying belt 9*a* is an absorption roller 9*f* for pinching the transfer material together with the electrostatic conveying belt 9*a* and for absorbing the transfer material onto the electrostatic conveying belt 9*a*. In conveying the transfer material, an electric voltage is applied to the absorption roller 9*f* to create an electric field between the absorption roller 9*f* and a roller 9*c* oppositely contacting thereto, and a dielectric polarization is created between the electrostatic conveying belt 9*a* and the transfer material so that the electrostatic conveying belt 9*a* and the transfer material become electrostatically absorbed to each other.

(Supporting Conveying Structure)

In conveying the transfer material S with the electrostatic conveying belt 9*a*, a supporting member does not only prevent the transfer material S from peeling from the electrostatic conveying belt 9*a*, but also serves as a transporting means for transporting the electrostatic conveying belt 9*a* to a secondary position (described afterwards) by being arranged on one side of the electrostatic conveying belt 9*a* where the transfer material is carried.

More specifically, conveyance supporting rollers 14 serving as plural supporting members capable of being driven rotatively are arranged on the front surface of the electrostatic conveying belt 9*a*, and the conveyance supporting rollers 14 uniformly move left and right owing to a cam mechanism (not shown).

In color recording, the conveyance supporting rollers 14 are withdrawn in a left direction and separated from the electrostatic conveying belt 9*a*. On the other hand, in monochrome recording, the cam mechanism moves the conveyance supporting rollers 14 in a right direction so that the conveyance supporting rollers 14 contact and push against the electrostatic conveying belt 9*a*. Therefore, even though the electrostatic conveying belt 9*a* remains in contact with a black photosensitive drum 1*d*, the electrostatic conveying belt 9*a* is separated from the rest of the photosensitive drums 1*a*, 1*b*, 1*c*.

(Fixing Portion)

A fixing portion 10 serves to fix an image formed on the transfer material (toner image) by applying heat and pressure Reference numeral 10*a* represents a cylindrical fixing belt having an electromagnetic heating layer, and the cylindrical fixing belt 10*a* is guided by a belt-guide member 10*c* having a built-in magnetic field generating means comprising an excitation coil and a T-letter shaped magnetic core.

Reference numeral 10*b* represents an elastic pressure roller, in which the elastic pressure roller 10*b* and the belt-guide member 10*c* pinch the fixing belt 10*a* disposed therebetween with a prescribed contacting pressure so as to form a fixing nip portion N having a prescribed width.

The pressure roller 10*b* is rotatively driven by a driving means (not shown), and in association with such rotary drive, the cylindrical fixing belt 10*a* rotates and begins electromagnetic heating caused by the supply of electricity from an excitation circuit (not shown) to the excitation coil.

In a state where the temperature of the fixing nip portion N is adjusted to a prescribed temperature, the transfer material S having an unfixed toner image is conveyed from the image forming portion, is guided between the fixing belt 10*a* and the pressure roller 10*b* of the fixing nip portion N having an image face thereof faced upward, that is, faced against the surface of the fixing belt, and is pinched and conveyed between the fixing nip portion N along with the fixing belt 10*a* in a manner where the image face thereof contacts to the outer surface of the fixing belt 10*a* .

In the process where the transfer material is conveyed by the fixing nip portion N and the fixing belt 10*a*, the transfer material is heated by the electromagnetic heating from the fixing belt 10*a* to thermally fix the unfixed toner image onto the transfer material S.

(Other Embodiment)

In the above-described embodiment, although a D-cut portion 26 is formed for intermittently blocking the sensor light from the sensor 20, the shape of the notch is not to be restricted to such form, and it is possible for a perforation to be formed instead.

In the above-described embodiment, although an example of an image forming apparatus having four single color image forming means is explained, the number of the image forming means is not to be limited, and can be set with an appropriate number in accordance to necessity.

Further, although an example of an image forming apparatus such as a printer is explained in the above-described embodiment, this invention is not to be limited to the foregoing image forming apparatus, but can also obtain the same effect when applied to other image forming apparatuses such as a copying machine, a facsimile or the like, or an image forming apparatus which uses an intermediary transfer belt (intermediary transferring body) as the endless belt, carries an image formed on each photosensitive drum by primary transfer upon the intermediary transfer belt, and transfers the toner image on the intermediary transfer belt of each color onto a transfer medium such as a conveyed recording sheet with a single action (secondary transfer).

As above-explained, this invention can precisely detect a change in speed of an endless belt caused by internal warming of the image forming apparatus body or the change in environmental temperature, restrain such change in speed of the endless belt, and prevent slight deviation of color or unevenness in density.

What is claimed is:

1. An image forming apparatus comprising:

an endless belt for carrying an image or for conveying an image forming medium;

a driving roller for supporting the endless belt and driving the endless belt;

a driven roller for supporting the endless belt and being driven in correspondence to movement of the endless belt;

an image forming means for forming an image to the endless belt or to a medium conveyed by the endless belt;

a speed detection means for detecting moving speed of the endless belt; and a speed control means for controlling the moving speed of the endless belt based on a detection result from the speed detection means;

wherein the speed detection means generates one pulse per rotation of the driven roller being driven in correspondence to the endless belt.

2. The image forming apparatus according to claim 1, wherein the speed detection means has a notch or a perforation formed at a portion of the driven roller, and a sensor for detecting light, and wherein the sensor of the speed detection means detects passage and blockage of light from the notch or the perforation and generates a signal.

3. The image forming apparatus according to claim 2, wherein the notch or the perforation is formed on an axis of the driven roller, and the sensor is attached to an axial bearing of the driven roller or attached to an axial bearing securing member for securing the axial bearing to define a relative position between the speed detection means and the axis of the driven roller.

4. The image forming apparatus according to claim 2, wherein the notch or the perforation is formed on an end portion of the axis of the driven roller;

wherein the sensor has a light emitting portion and a light receiving portion; and wherein the light receiving portion intermittently receives a sensor light from the light emitting portion by disposing the end portion of the axis of the driven roller between the light emitting portion and the light receiving portion.

5. The image forming apparatus according to claim 1, wherein the speed control means is based on a pulse count of the driven roller when the value of movement of the endless belt is substantially equal to a common multiple of a peripheral length of the driven roller and a peripheral length of the driving roller.

6. The image forming apparatus according to claim 1, wherein the speed detection means is based on a pulse count of the driven roller when the value of movement of the endless belt is substantially equal to a common multiple of a peripheral length of the driven roller and a peripheral length of the endless belt.

7. The image forming apparatus according to claim 1, wherein the driven roller has a coefficient of linear expansion substantially equal to a coefficient of linear expansion for a member defining an interval of the image forming means when a plurality of the image forming means are disposed with a predetermined interval on the endless belt.

8. An endless belt driving apparatus comprising:

an endless belt;

a driving rotary body for supporting the endless belt and driving the endless belt;

a driven rotary body being rotary driven in correspondence to movement of the endless belt;

a rotation-count detection means for detecting a rotation-count of the driven rotary body; and a speed control means for detecting a rotation of a prescribed first integral count of the driven rotary body with the rotation-count detection means and for controlling the driving rotary body so that the time required for the driven rotary body to rotate at the prescribed first integral count becomes substantially uniform;

wherein a moving distance of said endless belt to rotate said driven rotary body at the first prescribed integral count is substantially equal to a moving distance of said endless belt when said driving rotary body rotates at a second prescribed integral count.

9. The endless belt driving apparatus according to claim 8, wherein the driven rotary body and the driving rotary body are formed with a size so that the moving distance of the endless belt derived when the driven rotary body is rotated at the first prescribed integer count is substantially equal to the moving distance of the endless belt derived when the driven rotary body is rotated at a second prescribed integral count.

10. The endless belt driving apparatus according to claim 8, wherein the moving distance of the endless belt derived when the driven rotary body is rotated at the first prescribed integral count is set substantially equal to the moving distance of the endless belt derived when the driven rotary body is rotated at a third prescribed integral count.

11. The endless belt driving apparatus according to claim 8, wherein the driven rotary body and the driving rotary body and the endless belt are formed with a size so that the moving distance of the endless belt derived when the driven rotary body is rotated at the first prescribed integral count, the moving distance of the endless belt derived when the driven rotary body is rotated at a second prescribed integral count, and the moving distance of the endless belt derived when the driven rotary body is rotated at a third prescribed integral count are substantially equal.

12. The endless belt driving apparatus according to claim 8, wherein the rotation-count detection means generates a signal of one pulse per rotation of the driven rotary body.

13. The endless belt driving apparatus according to claim 8, wherein the rotation-count detection means generates a plurality of pulse signals per rotation of the driven rotary body.

14. The endless belt driving apparatus according to claim 8, wherein the endless belt conveys a sheet and has an image forming means for forming an image to a sheet conveyed by the endless belt.

15. The endless belt driving apparatus according to claim 14, wherein the image forming means has a plurality of image carriers for carrying an image to be transferred to a sheet conveyed by the endless belt; and wherein the driven rotary body has a coefficient of linear expansion substantially equal to a coefficient of linear expansion of a supporting member for supporting the plurality of image carriers.

* * * * *

UNITED STATES PATENT AND TRADEMARK OFFICE

CERTIFICATE OF CORRECTION

PATENT NO. : 6,834,174 B2
DATED : December 21, 2004
INVENTOR(S) : Imaizumi et al.

It is certified that error appears in the above-identified patent and that said Letters Patent is hereby corrected as shown below:

Title page,
Item [56], References Cited, FOREIGN PATENT DOCUMENTS,
"55164364 A" should read -- 55-164364A --;
"07303385 A" should read -- 7-303385A --;
"09267946 A" should read -- 9-267946A --;
"10206445 A" should read -- 10-206445A --;
"2000330353 A" should read -- 2000-330353A --.

Column 9,
Line 8, "sure" should read -- sure. --.

Signed and Sealed this

Eleventh Day of October, 2005

JON W. DUDAS
*Director of the United States Patent and Trademark Office*